United States Patent [19]

Dondelewski

[11] 4,183,730

[45] * Jan. 15, 1980

[54] HYDRODESULFURIZATION OF COAL WITH HYDROGEN PEROXIDE IN BRINE SOLUTION

[75] Inventor: Michael A. Dondelewski, Columbus, Ohio

[73] Assignee: Coalmet Corporation, Columbus, Ohio

[ * ] Notice: The portion of the term of this patent subsequent to Nov. 28, 1995, has been disclaimed.

[21] Appl. No.: 953,011

[22] Filed: Oct. 25, 1978

Related U.S. Application Data

[63] Continuation-in-part of Ser. No. 827,450, Aug. 25, 1977, Pat. No. 4,127,390.

[51] Int. Cl.[2] ..... C10L 9/10; C10B 57/00

[52] U.S. Cl. ..... 44/1 SR; 201/17

[58] Field of Search ..... 44/1 SR; 201/17

[56] References Cited

U.S. PATENT DOCUMENTS

| | | | |
|---|---|---|---|
| 3,993,456 | 11/1976 | Cole et al. | 44/1 SR |
| 4,097,244 | 6/1978 | Burk, Jr. et al. | 44/1 SR |
| 4,105,416 | 8/1978 | Burk, Jr. et al. | 44/1 SR |
| 4,127,390 | 11/1978 | Dondelewski | 44/1 SR |

*Primary Examiner*—Carl F. Dees

*Attorney, Agent, or Firm*—Webb, Burden, Robinson & Webb

[57] ABSTRACT

A process for reducing the sulfur content of coal and the like by treatment with an aqueous solution of sodium chloride and hydrogen peroxide.

4 Claims, 1 Drawing Figure

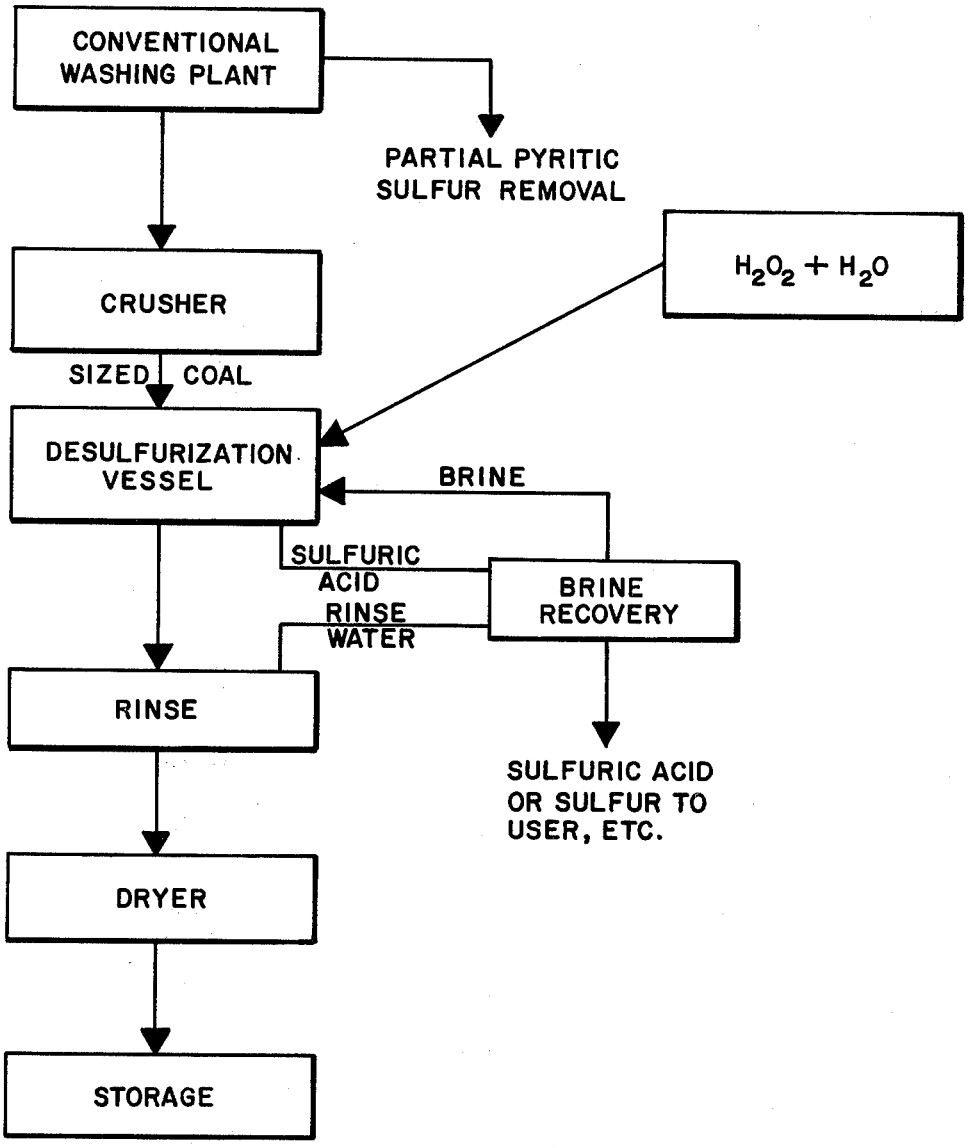
CONVENTIONAL WASHING PLANT
PARTIAL PYRITIC SULFUR REMOVAL
$H_2O_2 + H_2O$
CRUSHER
SIZED COAL
DESULFURIZATION VESSEL
BRINE
SULFURIC ACID
RINSE WATER
BRINE RECOVERY
RINSE
SULFURIC ACID OR SULFUR TO USER, ETC.
DRYER
STORAGE

HYDRODESULFURIZATION OF COAL WITH HYDROGEN PEROXIDE IN BRINE SOLUTION

RELATED APPLICATIONS

This application is a continuation-in-part of application Ser. No. 827,450, filed Aug. 25, 1977 and now U.S. Pat. No. 4,127,390 entitled "Hydrodesulfurization of Coal and the Like."

BACKGROUND

Coal as a fuel is an abundant source of energy comprising mostly carbon and small percentages of hydrogen, sulfur and ash. When coal is burned to produce energy, the presence of sulfur and ash is generally undesirable. The sulfur and ash enter the atmosphere with the combustion products creating air pollution. The ash enters the air as particulates and the sulfur as noxious sulfur oxide gases.

Numerous processes have been proposed for upgrading coal by sulfur removal. A portion of the sulfur can be removed by existing technology, namely, "coal washing." This process removes pyritic sulfur which exists in natural coal in the form of separate particles ranging from the very small to large nuggets. The sulfur which cannot be removed by washing can only be removed by chemical processes. Generally speaking, there are three chemical coal desulfurization techniques disclosed in the prior art: (1) oxidation of sulfur in the coal to form soluble sulfates; (2) reduction of the sulfur to elemental sulfur in which form it can be vaporized or removed by organic solvents; and (3) reaction with hydrogen to form gaseous hydrogen sulfide.

For any sulfur removal process to be practical it must be adaptable to handling of large volumes of materials very economically. Hence, the reactants should be inexpensive and capable of being recycled and the apparatus should be rugged and simple. In the processes disclosed herein, the reactants are very common; namely, salt and hydrogen peroxide. Salt is available in many forms including brines pumped out of the ground and hydrogen peroxide is available in carload quantities. It is manufactured by several processes one of which includes the electrolysis of sulfate radicals, for example the electrolysis of sulfuric acid.

DESCRIPTION OF THE PRIOR ART

An ancient U.S. Pat. No. 28,543 (issued in 1860) discloses a process for the removal of sulfur after coking wherein a mixture of sodium chloride, manganese peroxide, resin and water is applied to the red-hot coke and sulfur is oxidized and released from the coke mass in gaseous form. U.S. Pat. No. 4,022,588 teaches a process in which coal is ground very fine and treated with an aqueous oxidant; namely, a manganese, vanadium or cerium metal oxide under reflux conditions. It is further taught that strong aqueous oxidants such as hydrogen peroxide are unsuitable.

SUMMARY OF THE INVENTION

Briefly, according to this invention coal or the like is desulfurized by contacting the coal with an aqueous solution of hydrogen peroxide and sodium chloride at moderately elevated temperatures, separating the coal from the solution and washing the coal. Various methods may be used to separate the sulfur and/or sulfur compounds from the coal after the aqueous reaction.

THE DRAWING

The drawing is a flow diagram relating to a large scale implementation of the process according to this invention.

DETAILED DESCRIPTION OF THE INVENTION

According to this invention, raw coal is initially crushed or ground to a size which is easily handleable. It is preferable that the coal have a more or less uniform size. The coal is then introduced into a reaction vessel (opened or sealed) where it is caused to react with a solution of hydrogen peroxide and sodium chloride. For improved liquid solids contact the content of the reaction vessel is slowly stirred. It is preferable that the process be carried out in rubber-lined vessels or tanks since strong acid solutions are formed. A moderate heating of the vessel may be required to get the reaction started but after the reaction has begun, the process generates its own heat. It has been found that the conditions within the reaction vessel that bring about the greatest sulfur reduction in the coal vary for the particular type of coal being processed. The concentration of sodium chloride may vary between wide limits depending upon the coal and the vessel conditions. The best concentration can be determined by simply testing. A starting point of a saturated brine solution is prescribed. The ratio of coal to hydrogen peroxide and sodium chloride solution is not critical but the solution should be present in sufficient amount to carry away all the sulfur removed. Of course, at least three moles of hydrogen peroxide ($H_2O_2$) are required for each mole of sulfur to be removed. Since one hundred percent efficiency of oxidation does not take place, it is necessary that excess hydrogen peroxide be added to the vessel preferably in successive stages. Applicant has found that solutions ranging from three to fifteen percent hydrogen peroxide are very suitable and there appears to be no reason why yet higher concentrations of hydrogen peroxide in the solution could not be used. The solution must be heated to a higher temperature to initiate the sulfur oxidizing reaction when lower concentrations of hydrogen peroxide are used. On the other hand, with high sulfur coals and higher hydrogen peroxide concentrations, cooling the reaction vessel may become necessary.

While not wanting to be tied to particular reactions, it is believed that sulfur dioxide is formed in the reaction vessel which in turn results in sulfurous and sulfuric acid. Tests also showed the formation of hydrochloric acid. The formation of these acids results in a reaction with the ash content of the coal resulting in a reduction in the ash content of the final product.

After the reaction period, which may be as little as 2 to 15 minutes, the treated coal is rinsed in hot water.

The following bench scale laboratory tests illustrate the effectiveness of the process according to this invention for removing sulfur, and to some degree ash, from raw coal.

The coal samples described in the following table were used in the examples described hereafter.

TABLE

| Coal Indentification | Sulfur Percent | Ash Percent | BTU/ Pound |
|---|---|---|---|
| Coal A | 4.50 | 13.87 | 12,758 |
| Coal B | 2.88 | 14.91 | 12,031 |

TABLE-continued

| Coal Indentification | Sulfur Percent | Ash Percent | BTU/ Pound |
|---|---|---|---|
| Coal C | 8.51 | 12.35 | 11,546 |
| Coal D | 8.26 | 25.23 | 10,281 |

EXAMPLE NUMBER 1

Raw coal A (see table) was crushed to approximately 3/16×0 mesh size. A 200 gram sample was introduced into a glass container along with 50 grams of salt and 300 milliliters of three percent hydrogen peroxide solution. The vessel and its contents were heated to about 140° F. (60° C.) and maintained at that temperature. At a temperature of about 120° F. (49° C.) the solution began to fizzle or give off gases. Fumes rose from the vessel. When the reactions as observed by the fizzling subsided an additional quantity of hydrogen peroxide solution and salt were added. The contents of the container reacted vigorously again with the fresh solution. At this time, the coal was separated from the reaction liquid and washed and dried. Coal was then analyzed as follows:

Sulfur—3.28%
Ash—11.32%
BTU/pound—12,124

EXAMPLE NUMBER 2

The steps of Example 1 were repeated with an additional step in which the treated coal was heated to a temperature of about 450° F. (232° C.) for about 30 minutes. An acid and sulfurous smell was given off by the coal.

The fully treated coal sample analyzed:
Sulfur—2.38%
Ash—9.19%
BTU/pound—12,049

EXAMPLE NUMBER 3

The steps of Example 1 were repeated using a six percent solution of hydrogen peroxide in place of the three percent solution. Reactions began on heating to about 90° F. (32° C.).

The treated coal analyzed as follows:
Sulfur—1.30%
Ash—11.37%
BTU/pound—11,121

EXAMPLE NUMBER 4

The desulfurized specimen of Example 3 was subjected to a further washing step using hot water. Further, the coal was floated with air bubbles to separate residue that did not appear to be coal.

The treated coal analyzed as follows:
Sulfur—0.87%
Ash—7.44%
BTU/pound—11,672

EXAMPLE NUMBER 5

Raw coal C (see table) was crushed and treated with a fifteen percent solution of hydrogen peroxide in a saturated or near saturated salt solution in an open pyrex vessel. The sulfur content was reduced from 8.51% to 5.09%. (The decanted liquor analyzed about four percent and had a pH of 1.65.) While the reduction of sulfur was in the order of 2.5%, the toal sulfur content remaining was still too high for the coal to be considered suitable. By retreating this coal in the same manner, it was possible to produce a treated coal which analyzed as follows:

Sulfur—1.80%
Ash—15.03%
BTU/pound—10,997

(The decanted liquor had a sulfur content of about three percent and a pH of 2.08.)

Seeking yet another way to obtain a coal having a suitably low sulfur content, a portion of the coal treated to reduce it to 5.09% sulfur was floated to cause a separation. The floated coal sample recovered had the following analysis:

Sulfur—2.36%
Ash—10.45%
BTU/pound 11,631

The materials remaining after the floatation at the bottom of the vessel analyzed twelve percent sulfur. The floatation occurred in a solution having a 1.6 to 1.7 specific gravity. All elemental sulfur produced in the reaction and any particles with sufficient pyrite to increase their specific gravity above that of the solution settled out in this process.

EXAMPLE NUMBER 6

By way of comparison to Example No. 5, coal C was treated in a sealed stainless steel vessel. The sulfur content was only reduced from 8.51% to 6.60% suggesting that metal liners for the reaction vessel are unsatisfactory. (The decanted liquor analyzed about two percent sulfur and had a pH of 2.33.) Acid pitting of the stainless steel vessel was observed.

EXAMPLE NUMBER 7

Coal B was crushed and reacted with a fifteen percent hydrogen peroxide solution saturated or near saturated with salt in a closed stainless steel vessel. The sulfur was somewhat reduced from 2.88% to only 2.38%. In another run, the treated coal specimen analyzed as follows:

Sulfur—1.34%
Ash—12.91%
BTU/pound—11,632

The decanted liquor after the coal treatment analyzed about one percent sulfur and had a pH of 2.30. In yet another run in an open vessel the sulfur was reduced from 2.88% to 2.21%.

EXAMPLE NUMBER 8

Raw coal D (see table) was crushed and reacted with a fifteen percent hydrogen peroxide solution saturated or near saturated with salt in an open pyrex lined vessel. The treated coal analyzed:

Sulfur—1.42%
Ash—12.92%

In a repeat using a fresh coal sample, the treated coal analyzed as follows:

Sulfur—1.45%
Ash—18.16%
BTU/pound—11,442

The decanted liquor after coal treatment analyzed almost seven percent sulfur and had a pH of 1.62. The reaction of this coal with the hydrogen peroxide brine solution was very exothermic and it was necessary to actually cool the vessel to prevent its contents from boiling.

The presence of sodium chloride in the solution is believed by applicant to be essential to the effectiveness of this process. It has been observed to increase the oxidation rate of the sulfur. Where coals have been placed in a solution of hydrogen peroxide without brine the reaction would cease very quickly. The subsequent addition of salt restarted and extended the reaction as observed by gas evolution.

Referring now to the drawing, there is shown a flow diagram describing the large scale implementation of the process according to this invention. Raw coal may be first washed by conventional methods in order to remove solid rock and other waste material. The washing has the effect of removing a portion of the pyritic sulfur, thus reducing the sulfur loading in subsequent stages of the process. Thereafter, the cleaned coal is passed through a crusher where coal of a more or less uniform lump size is produced. From the crusher, the coal enters a desulfurization vessel, where under moderate temperatures and in a solution of hydrogen peroxide and salt, sulfur is removed from the coal and the liquor becomes filled with sulfur and highly acidic. A sulfuric acid solution is produced which is passed to a recovery stage. It is possible that this liquor could be used in an electrolysis process to form additional hydrogen peroxide before the sulfur is removed from the liquor as a by-product. In any event, a by-product of this process is sulfuric acid or sulfur. The coal is removed from the desulfurization vessel and rinsed with hot water. The rinse water is also returned to a recovery stage. The recovery water or brine is recycled, if possible. The rinsed coal is dried and stored.

This invention is applicable to fossil fuel or coal where the meaning of the terms includes, for example, anthracite, lignite, bituminous coal and so forth. The term sulfur as used in this application refers to any combination of free or chemically bound sulfur in the form of monosulfates and polysulfates and it also refers to chemically bound sulfur commonly known as pyrite.

It is believed that in some cases, elemental sulfur is produced and retained within the coal after treating with the solution of hydrogen peroxide and brine. If extremely low sulfur coals are desired it may be possible to separate this sulfur from the coal mass by the following methods: (a) vaporization of the sulfur at about 450° F. or at a lower temperature under a vacuum, (b) dissolving the elemental sulfur in an organic solvent such as benzine, p-creosol, kerosene, etc., (c) through the method of air heavy density medium floatation.

Having thus described my invention with the detail and particularity as required by the Patent Laws, what is desired protected by Letters Patent is set forth in the following claims.

1. A method of treating coal to reduce total sulfur content consisting of a. crushing and sizing the coal to a more or less homogenous size,
b. combining the coal with a solution of hydrogen peroxide and sodium chloride,
c. heating the coal in the solution just sufficiently to start a reaction,
d. holding the coal in the solution at a moderately elevated temperature for a period of time until the reaction is complete,
e. removing the coal from the solution and washing with hot water, and
f. recovering coal having a reduced sulfur and ash content.

2. The method as set forth in claim 1 wherein air is introduced into the reaction vessel.

3. The method according to claim 1 wherein the solution comprises a hydrogen peroxide concentration of three to ten percent and a near saturated brine content and the reaction is started by heating to about 120° F.

4. The method according to claim 1 wherein the solution comprises a concentration of ten to thirty percent hydrogen peroxide and a near saturated solution of sodium chloride and the reaction is initiated by heating to about 90° F.

* * * * *